US005595194A

United States Patent [19]

Talbot

[11] Patent Number: 5,595,194

[45] Date of Patent: Jan. 21, 1997

[54] PIVOTALLY MOUNTABLE ASH TRAY

[76] Inventor: Adam J. Talbot, 4107 Woodland Ave., Brookhaven, Pa. 19015

[21] Appl. No.: 511,635

[22] Filed: Aug. 7, 1995

[51] Int. Cl.[6] ..... A24F 15/08

[52] U.S. Cl. ..... 131/241; 131/235.1

[58] Field of Search ..... 131/231, 235.1, 131/240.1, 241, 242, 329, D27, 102–106; 206/246, 256, 261, 268

[56] References Cited

U.S. PATENT DOCUMENTS 1,504,310 8/1924 Balkus ..... 131/241

3,370,820 2/1968 Liss et al. ..... 131/241

*Primary Examiner*—V. Millin
*Assistant Examiner*—Charles W. Anderson

[57] ABSTRACT

An ash tray for supporting ashes and smoking materials in a vertical orientation relative to a tilting support. The inventive device includes an ash receptacle for receiving ashes and supporting cigarettes. A pivotal mounting assembly extends from the ash receptacle for coupling to a golf bag such that as the golf bag is tilted, the ash receptacle will remain vertical.

5 Claims, 4 Drawing Sheets

Fig. 1
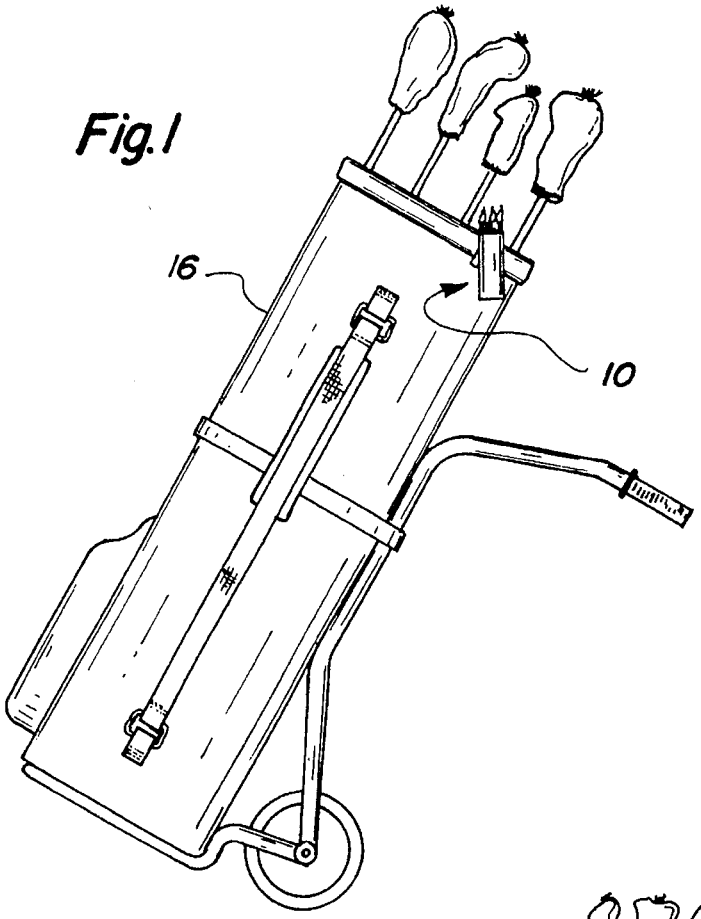
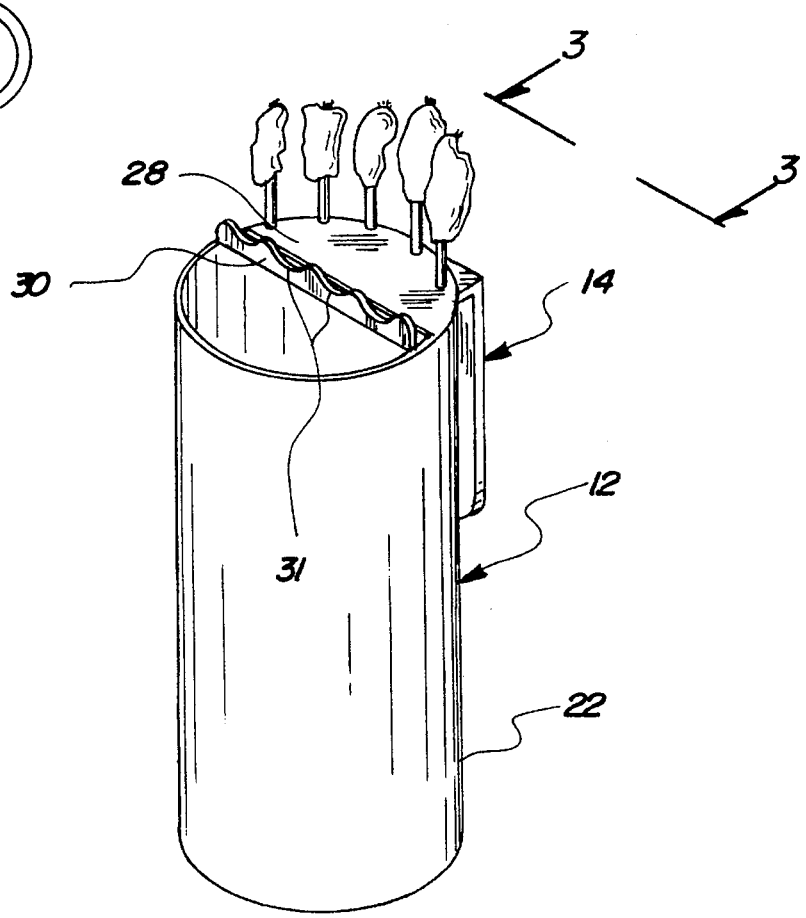
Fig. 2

PIVOTALLY MOUNTABLE ASH TRAY

BACKGROUND OF THE INVENTION

1. Field of the Invention

The present invention relates to ash tray structures and more particularly pertains to an pivotally mountable ash tray for supporting ashes and smoking materials in a vertical orientation relative to a tilting support.

2. Description of the Prior Art

The use of ash tray structures is known in the prior art. More specifically, ash tray structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art ash tray structures include U.S. Design Pat. No. 302,050; U.S. Design Pat. No. 307,947; U.S. Pat. No. 4,587,980; U.S. Pat. No. 5,224,499; and U.S. Pat. No. 5,199,449.

While these devices fulfill their respective, particular objectives and requirements, the aforementioned patents do not disclose a pivotally mountable ash tray for supporting ashes and smoking materials in a vertical orientation relative to a tilting support which includes an ash receptacle for receiving ashes and supporting cigarettes, and a pivotal mounting assembly extending from the ash receptacle for coupling to a golf bag such that as the golf bag is tilted, the ash receptacle will remain vertical.

In these respects, the pivotally mountable ash tray according to the present invention substantially departs from the conventional concepts and designs of the prior art, and in so doing provides an apparatus primarily developed for the purpose of supporting ashes and smoking materials in a vertical orientation relative to a tilting support.

SUMMARY OF THE INVENTION

In view of the foregoing disadvantages inherent in the known types of ash tray structures now present in the prior art, the present invention provides a new pivotally mountable ash tray construction wherein the same can be utilized for supporting ashes and smoking materials relative to a tilting support. As such, the general purpose of the present invention, which will be described subsequently in greater detail, is to provide a new pivotally mountable ash tray apparatus and method which has many of the advantages of the ash tray structures mentioned heretofore and many novel features that result in a pivotally mountable ash tray which is not anticipated, rendered obvious, suggested, or even implied by any of the prior art ash tray structures, either alone or in any combination thereof.

To attain this, the present invention generally comprises an ash tray for supporting ashes and smoking materials in a vertical orientation relative to a tilting support. The inventive device includes an ash receptacle for receiving ashes and supporting cigarettes. A pivotal mounting assembly extends from the ash receptacle for coupling to a golf bag such that as the golf bag is tilted, the ash receptacle will remain vertical.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pivotally mountable ash tray apparatus and method which has many of the advantages of the ash tray structures mentioned heretofore and many novel features that result in a pivotally mountable ash tray which is not anticipated, rendered obvious, suggested, or even implied by any of the prior art ash tray structures, either alone or in any combination thereof.

It is another object of the present invention to provide a new pivotally mountable ash tray which may be easily and efficiently manufactured and marketed.

It is a further object of the present invention to provide a new pivotally mountable ash tray which is of a durable and reliable construction.

An even further object of the present invention is to provide a new pivotally mountable ash tray which is susceptible of a low cost of manufacture with regard to both materials and labor, and which accordingly is then susceptible of low prices of sale to the consuming public, thereby making such pivotally mountable ash trays economically available to the buying public.

Still yet another object of the present invention is to provide a new pivotally mountable ash tray which provides in the apparatuses and methods of the prior art some of the advantages thereof, while simultaneously overcoming some of the disadvantages normally associated therewith.

Still another object of the present invention is to provide a new pivotally mountable ash tray for supporting ashes and smoking materials in a vertical orientation relative to a tilting support.

Yet another object of the present invention is to provide a new pivotally mountable ash tray which includes an ash receptacle for receiving ashes and supporting cigarettes, and a pivotal mounting assembly extending from the ash receptacle for coupling to a golf bag such that as the golf bag is tilted, the ash receptacle will remain vertical.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevation view of a pivotally mountable ash tray according to the present invention in use.

FIG. 2 is an isometric illustration of the invention, per se.

DESCRIPTION OF THE PREFERRED EMBODIMENT

Figure 3:
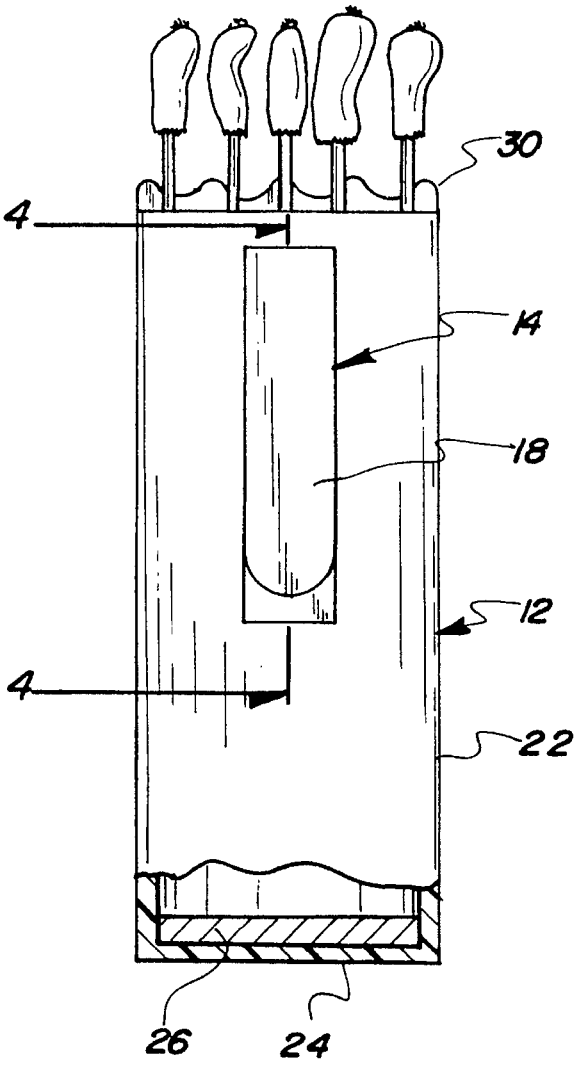
FIG. 3 is a rear elevation view of the invention taken from line 3—3 of FIG. 2.

With reference now to the drawings, and in particular to FIGS. 1–8 thereof, a new pivotally mountable ash tray embodying the principles and concepts of the present invention and generally designated by the reference numeral 10 will be described.

More specifically, it will be noted that the pivotally mountable ash tray 10 comprises an ash container 12 for receiving and supporting ashes as well as smoking materials such as cigarettes and/or cigars. A pivotal mounting means 14 is pivotally secured to the ash container 12 and can be engaged to a support object, such as the golf bag 16 illustrated in FIG. 1 of the drawings, for supporting the ash container 12 in a substantially vertical orientation relative to the support. By this structure, ashes and smoking materials can be supported relative to the golf bag 16, with the ash container 12 remaining in a substantially vertical orientation even during tilting of the golf bag 16 during transportation thereof about a golf course.

Figure 4:
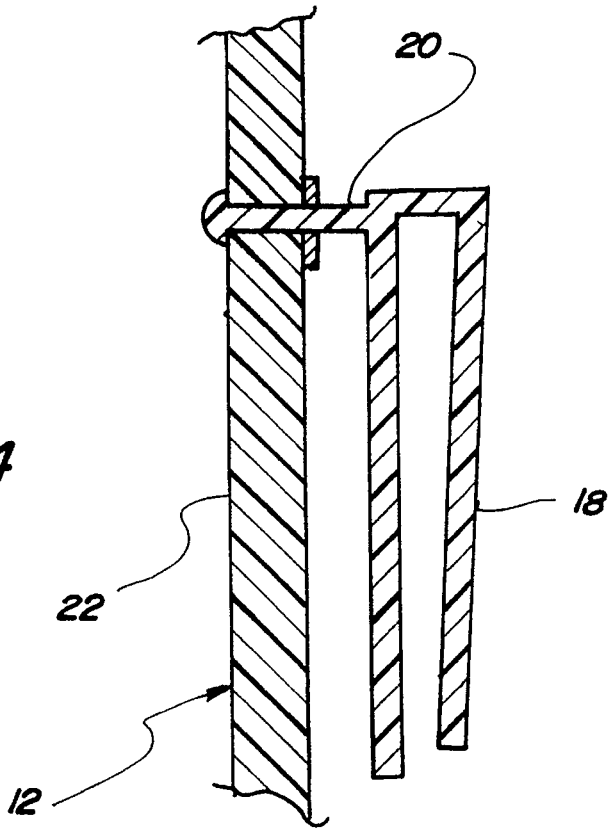
FIG. 4 is a cross-sectional view taken along line 4—4 of FIG. 3.
Figure 5:
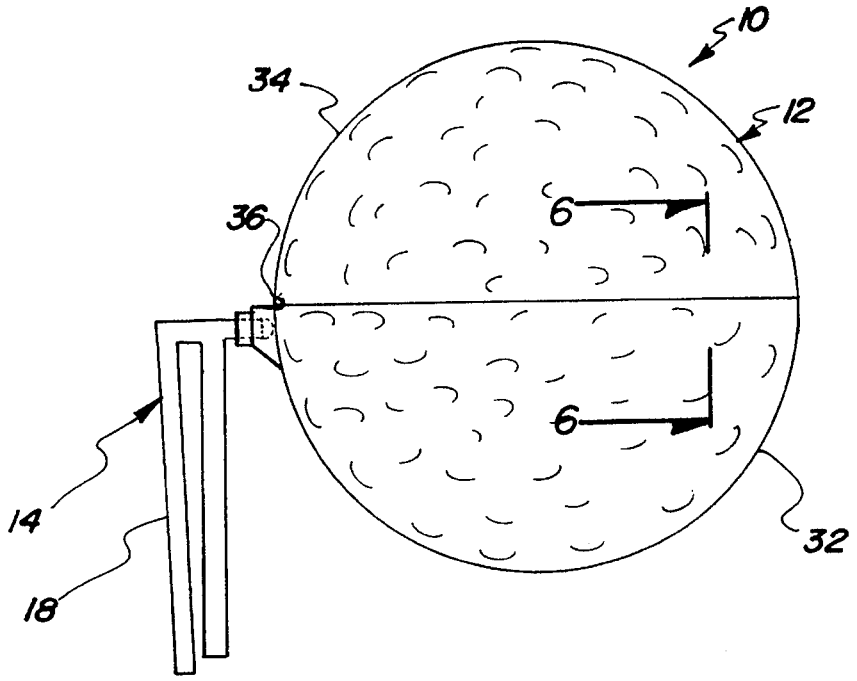
FIG. 5 is a side elevation view of an alternative form of the present invention.

As best illustrated in FIGS. 2 through 4, it can be shown that the pivotal mounting means 14 of the present invention 10 preferably comprises a substantially U-shaped clip 18 having a pivot pin 20 projecting therefrom. The pivot pin 20 is rotatably coupled to the ash container 12 such that the U-shaped clip 18 extends substantially parallel relative to an outer exterior of the ash container 12. By this structure, the U-shaped clip 18 can be frictionally engaged to a support object such as the golf bag 16 illustrated in FIG. 1 so as to support the ash container 12 depending therefrom. Because the pivot pin 20 is rotatably mounted to the ash container 12, the ash container will reside in the substantially vertical orientation even during tilting of the golf bag 16.

As best illustrated in FIGS. 2 and 3, it can be shown that the ash container 12 of the present invention 10 preferably comprises a substantially cylindrical sidewall 22 having a bottom wall 24 extending across a lower end thereof so as to close a bottom of the ash container 12. A weight 26 can be positioned within the ash container 12 along the bottom wall 24 thereof so as to ensure that the ash container 12 pivots relative to the mounting means 14 as the golf bag 16 is tilted. As shown in FIG. 2, a semi-circular top wall 28 extends across an open upper end of the cylindrical sidewall 22 so as to close approximately one half of the area thereof. A support member 30 having a plurality of notches directed therein similarly extends diametrically across the cylindrical sidewall 22, with the notches 31 operating to receive and support a smoking material such as a cigarette or cigar. By this structure, ashes can be deposited into the ash container 12 through the open upper end thereof, with snuffing of a smoking material being facilitated against the semi-circular top wall 28 when it is desired to extinguish such smoking material. Preferably, the support member 30 is oriented so as to extend in a substantially spaced and parallel orientation relative to a straight edge of the semi-circular top wall 28 such that ashes or the like residing upon the semi-circular top wall can simply be brushed or caused to fall through the open upper end of the cylindrical side wall 22 between the straight edge of the semi-circular top wall and the support member 30.

Figure 6:
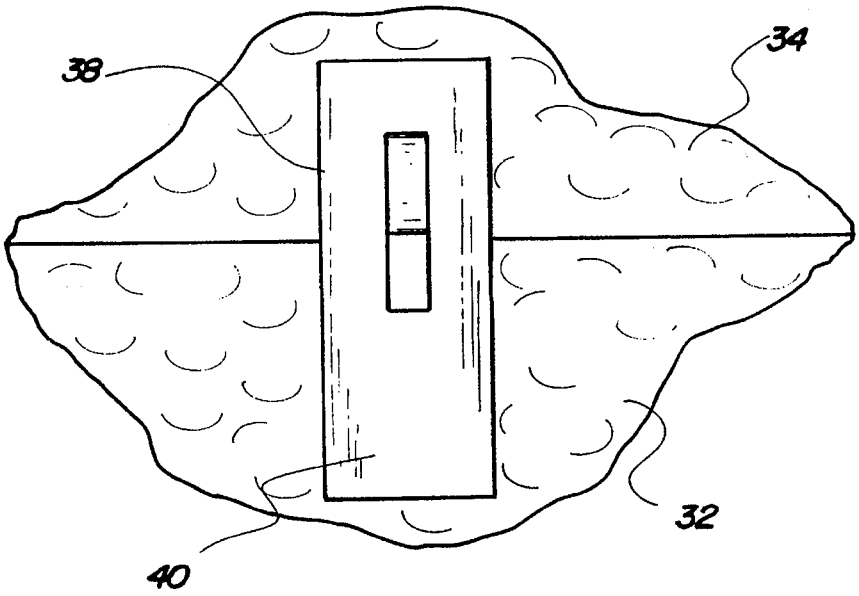
FIG. 6 is an enlarged elevation view taken from line 6—6 of FIG. 5.
Figure 7:
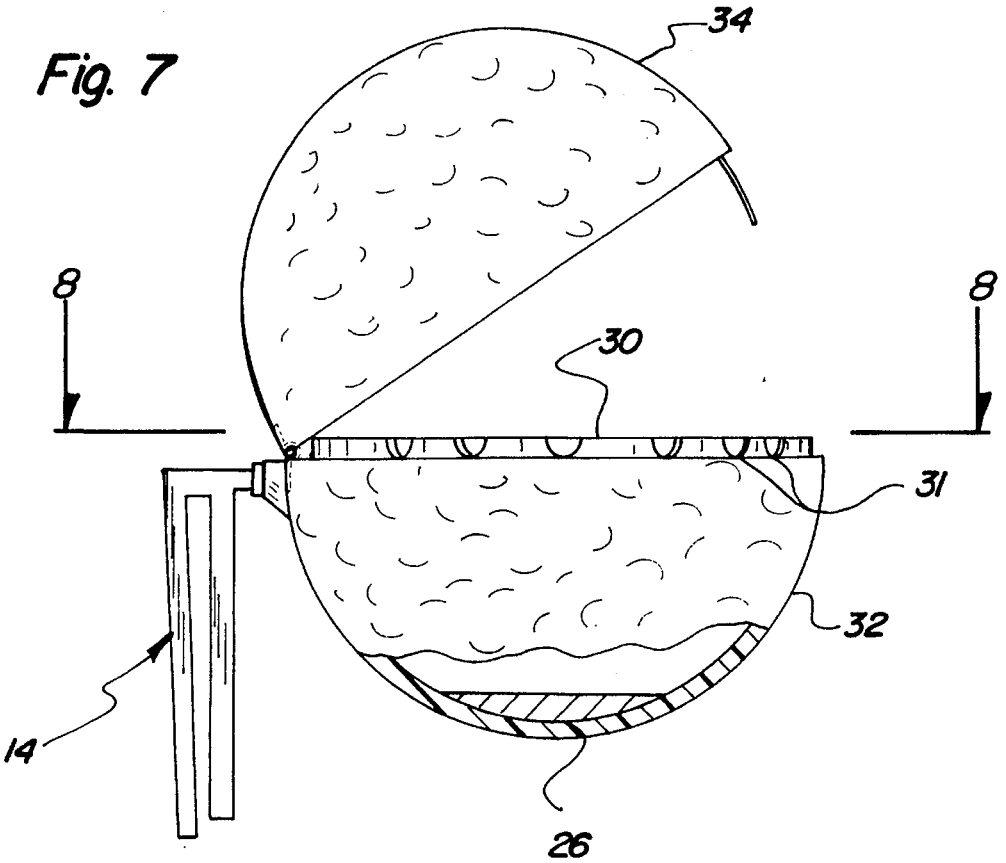
FIG. 7 is a side elevation view, partially in cross section, of the alternative form of the invention.

Referring now to FIGS. 5 through 8 of the drawings wherein an alternative form of the present invention 10 is illustrated in detail, it can be shown that the ash container 12 may alternatively comprise a lower hemi-spherical member 32 to which the pivotal mounting means 14 is pivotally or rotatably coupled. An upper hemi-spherical member 34 is pivotally mounted to the lower hemi-spherical member 32 by a hinge 36 interposed therebetween which permits an opening of the ash container 12 as illustrated in FIG. 7 of the drawings. A latch 38 is coupled to the ash container 12 and operates to maintain the upper hemi-spherical member 34 in a closed configuration relative to the lower hemi-spherical member 32 as desired and shown in FIG. 5 of the drawings.

The latch 38, as shown in FIG. 6, may comprise a flexible tab 40 secured to an interior of the upper hemi-spherical member 34 and shaped so as to define a center aperture directed therethrough. An unlabeled projection is secured to an interior surface of the lower hemi-spherical member 32, as shown in FIG. 6, and can be positioned through the center aperture of the flexible tab 40 so as to retain the upper hemi-spherical member 34 in the closed configuration. The flexible tab 40 will then be resiliently biased outwardly from the lower hemi-spherical member 32 during a manually forced separation of the hemi-spherical members so as to free the projection from the center aperture of the flexible tab to permit opening of the upper hemi-spherical member 34 into the position illustrated in FIG. 7. Alternatively, in lieu of or in addition to the flexible tab 40 and the projection, the latch 38 may comprise a spring loaded hinge such as is shown at 36 in FIG. 5 of the drawings to effect automatic closure of the upper hemi-spherical member relative to the lower hemi-spherical member.

Figure 8:
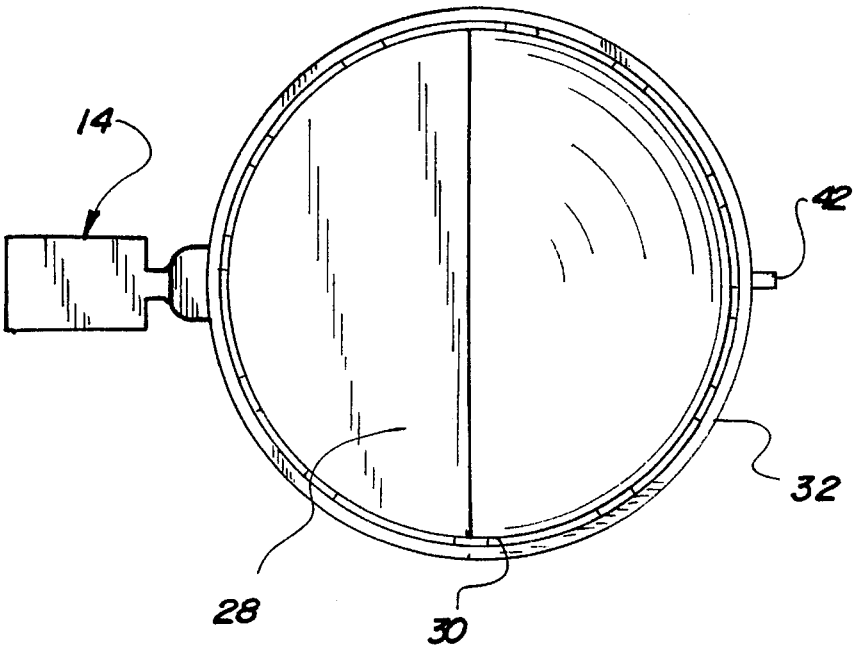
FIG. 8 is a top plan view taken from line 8—8 of FIG. 7.

Referring now to FIGS. 7 and 8, it can be shown that the support member 30 of the ash container 12 is preferably circular in shape and desirably extends about an open upper end of the lower hemi-spherical member 32. As shown in FIG. 8, the semi-circular top wall 28 extends substantially orthogonally across the open upper end of the lower hemi-spherical member 32 and operates to permit resting and/or snuffing of smoking materials thereagainst. The weight 26 can similarly be located in the lower portion of the lower hemi-spherical member 32 so as to cause the ash container 12 to assume the substantially vertical orientation illustrated in the drawings even during tilting of the golf bag 16 with the pivotal mounting means 14 attached thereto.

In use, the pivotally mountable ash tray 10 according to the present invention can be easily utilized for supporting ashes and smoking materials in a substantially vertical orientation relative to a tilting support.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pivotally mountable ash tray comprising:

an ash container for receiving and supporting ashes and smoking materials;

a pivotal mounting means pivotally secured to the ash container and engagable to a support object for supporting the ash container in a substantially vertical orientation relative to the support;

wherein the pivotal mounting means comprises a substantially U-Shaped clip having a pivot pin projecting therefrom, the pivot pin being rotatably coupled to the ash container such that the U-shaped clip extends substantially in a spaced relationship relative to an outer exterior of the ash container, wherein the U-shaped clip can be fictionally engaged to a support object so as to support the ash container depending therefrom;

wherein the ash container comprises a lower hemi-spherical member to which the pivotal mounting means is pivotally coupled;

an upper hemi-spherical member pivotally mounted to the lower hemi-shperical member;

a latah coupled to the ash container for maintaining the upper hemi-spherical member in a closed configuration relative to the lower hemi-spherical member;

a weight positioned in a lower portion of the lower hemi-spherical member.

2. The pivotally mountable ash tray of claim 1, wherein the latch comprises a flexible tab secured to an interior of the upper hemi-spherical member and shaped so as to define a center aperture directed therethrough; and a projection secured to an interior of the lower hemi-spherical member which can be positioned through the center aperture of the flexible tab so as to retain the upper hemi-spherical member in a closed configuration.

3. The pivotally mountable ash tray of claim 2, wherein the ash container further comprises a support member secured to the lower hemi-spherical member, the support member being circular in shape and extending about an open upper end of the lower hemi-spherical member.

4. The pivotally mountable ash tray of claim 3, wherein the ash container further comprises a semi-circular top wall extending substantially orthogonally across the open upper end of the lower hemi-spherical member.

5. The pivotally mountable ash try of claim 4, wherein the latch further comprises a spring loaded hinge pivotally interconnecting the lower hemi-spherical member with the upper hemi-spherical member.

* * * * *